US007800476B2

(12) United States Patent
Urabe et al.

(10) Patent No.: US 7,800,476 B2
(45) Date of Patent: Sep. 21, 2010

(54) COIL COMPONENT AND METHOD FOR PRODUCING THE SAME

(75) Inventors: Daisuke Urabe, Tokyo (JP); Yasuhiko Kitajima, Tokyo (JP); Takashi Ishii, Tsuruoka (JP); Hitoshi Sasaki, Tokyo (JP); Koji Shimura, Tokyo (JP); Yoshiyuki Takanashi, Tokyo (JP)

(73) Assignee: TDK Corporation, Tokyo (JP)

( * ) Notice: Subject to any disclaimer, the term of this patent is extended or adjusted under 35 U.S.C. 154(b) by 4 days.

(21) Appl. No.: 12/385,966

(22) Filed: Apr. 24, 2009

(65) Prior Publication Data

US 2009/0273426 A1 Nov. 5, 2009

(30) Foreign Application Priority Data

Apr. 30, 2008 (JP) ..... 2008-118609

(51) Int. Cl.
*H01F 27/29* (2006.01)
*H01F 5/00* (2006.01)
*H01F 27/02* (2006.01)

(52) U.S. Cl. ..... 336/192; 336/83; 336/200

(58) Field of Classification Search ..... 336/83, 336/200, 192, 223, 232
See application file for complete search history.

(56) References Cited

U.S. PATENT DOCUMENTS 6,535,095 B2 * 3/2003 Aoki et al. ..... 336/83
7,078,988 B2 * 7/2006 Suzuki et al. ..... 333/181
7,113,067 B2 * 9/2006 Hirai et al. ..... 336/192
7,373,725 B1 * 5/2008 Vanneman et al. ..... 33/293
7,688,173 B2 * 3/2010 Azuma et al. ..... 336/200

FOREIGN PATENT DOCUMENTS

| | | | |
|---|---|---|---|
| DE | 3938718 | A1 * | 5/1991 |
| JP | A-7-122452 | | 5/1995 |
| JP | A-10-92680 | | 4/1998 |
| JP | A-10-172822 | | 6/1998 |
| JP | A-10-335152 | | 12/1998 |
| JP | A-2002-15926 | | 1/2002 |
| JP | A-2002-118024 | | 4/2002 |
| JP | A-2002-289453 | | 10/2002 |
| JP | A-2005-311074 | | 11/2005 |
| JP | A-2007-115761 | | 5/2007 |

* cited by examiner

*Primary Examiner*—Anh T Mai
(74) *Attorney, Agent, or Firm*—Oliff & Berridge, PLC

(57) ABSTRACT

A coil component having a core, first and second terminal electrodes provided on the core, and a conducting wire having a winding portion provided on the core and end portions electrically connected to the first and second terminal electrodes to provide first and second connecting portions. The core has one side surface at which the first and second connecting portions are provided. When viewing the one side surface, a wire portion in the winding portion extends in a first direction, and a wire portion extending from the second connecting portion extends toward the winding portion in a second direction. The first and second directions define an intersection angle of not more than 90 degrees.

16 Claims, 8 Drawing Sheets

COIL COMPONENT AND METHOD FOR PRODUCING THE SAME

CROSS REFERENCE TO RELATED APPLICATION

This application claims priority from Japanese Patent Application No. 2008-118609 filed Apr. 30, 2008. The entire content of the priority application is incorporated herein by reference.

TECHNICAL FIELD

The present invention relates to a coil component and a method for producing the same.

BACKGROUND

Conventionally, known is a coil component having a core, terminal electrodes provided at ends of the core, and a conducting wire wound over the winding portion and having ends each electrically connected to each terminal electrode. For example, a drum type core has a core part and a pair of flange parts each coupled to each axial end of the core part. A terminal electrode is provided at each flange part. A conducting wire is wound over the core part to provide the winding portion, and each end of the wire is drawn toward each terminal electrode and is electrically connected thereto. Such coil component is described in laid-open Japanese Patent Application Kokai No. 2007-115761.

The JP publication discloses a method for electrical connection between the terminal electrode and the conducting wire, such as clamping connection or pressure bonding. Each end portion of the conducting wire is plastically deformed into flat shape on the terminal electrode upon application of pressure while minimizing a protruding amount of the deformed conducting wire out of the contour of the terminal electrode in electrical connection. The electrically connected portion is directed to directly oppose a electrically conducting pattern on a surface-mount board for electrical connection thereto.

However, upon pressure connection, the conducting wire is deformed so that the wire may be urged toward the winding portion so as to unwind the conducting wire with increasing a diameter of the winding portion. Therefore, a cross-sectional area of the coil is changed to vary the shape of the coil component and inductance (L) characteristic thereof. Requirement of minimization in size of the coil component is increased. Therefore, such variation may become remarkably predominant in the minimized coil component.

SUMMARY

It is therefore, an object of the present invention to provide a coil component having a reduced size and capable of avoiding variation in size and characteristic in inductance (L) characteristic.

Another object of the invention is to provide a method for producing such coil component.

These and other objects of the present invention will be attained by providing a coil component including a core, terminal electrodes, and a conducting wire. The core has a core surface and each end portion. Each of the terminal electrodes is provided at each end portion of the core. The conducting wire includes a winding portion wound over the core and end portions. The end portions include connecting portions each electrically connected to each terminal electrode and leading portions each provided between the winding portion and each connecting portion. Each leading portion includes a transit region connected to each connecting portion. The wire in the winding portion extends in a first direction on the core surface at a side identical to a side where the connecting portion is provided, and the transit region extends in a second direction toward the winding portion on the core surface. The first direction and the second direction define an angle therebetween of not more than 90 degrees.

According to another aspect, the present invention provides a method for producing a coil component including preparing a core provided with first terminal electrode and second terminal electrode, first electrically connecting one end portion of a conducting wire to the first terminal electrode to provide a first connecting portion, winding the conducting wire at a downstream of the one end portion over the core to provide a winding portion wherein the first connecting portion is defined herein as an upstream end, positioning a portion of the conducting wire at a downstream of the winding portion onto the second terminal electrode by holding a potential intermediary portion by a holder and bending the conducting wire at the holder toward the second terminal electrode to provide a potential leading portion, wherein the potential intermediary portion is positioned immediate downstream of the winding portion and becomes an intermediary portion, and the potential leading portion is positioned immediate downstream of the potential intermediary portion and becomes a leading portion including a transit region, and second electrically connecting the portion of the conducting wire immediate downstream of the leading portion to the second terminal electrode by applying pressure to the portion to provide a second connecting portion, the transit region being immediate upstream of the second connecting portion.

DETAILED DESCRIPTION

Figure 1:
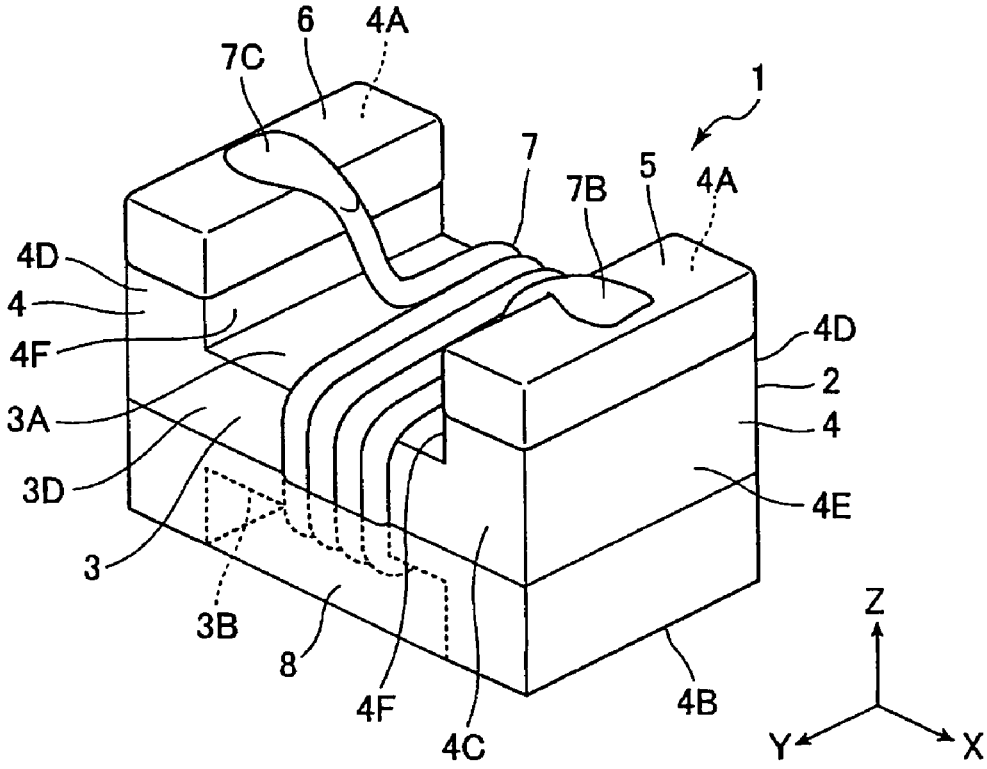
FIG. 1 is a perspective view of a coil component according to one embodiment of the present invention.

A coil component according to an embodiment of the present invention will be described with reference to FIGS. 1 through 3. The coil component 1 is available for use in high frequency and is produced by a method described later. As shown in FIG. 1, the coil component 1 includes a core 2 having a core part 3, a single conducting wire 7 wound over the core part 3, and a resin part 8.

The core 2 is so-called a drum type core and is made from a ceramic material. The core 2 includes the core part 3 having a generally rectangular cross-section taken in a plane perpendicular to its axial direction, and a pair of flanges 4 having a shape identical to each other and each formed at each end of the core part 3 in the axial direction. Since the pair of flanges 4 have their shapes identical to each other, only one of the flanges 4 will be described, unless otherwise indicated.

In the following description, the axial direction of the core part 3 will be referred to as "X-direction", a direction from right side to left side in FIG. 2 will be referred to as "X(+) direction", and a direction from the left side to the right side in FIG. 2 will be referred to as "X(−) direction". Further, a widthwise direction of the core part 3 in FIG. 2, i.e., vertical direction in FIG. 2 will be referred to as "Y direction", a direction from a lower side to an upper side in FIG. 2 will be referred to as "Y(+) direction", and a direction from the upper side to the lower side in FIG. 2 will be referred to as "Y(−) direction". Furthermore, a direction perpendicular to the X direction and Y direction will be referred to as "Z direction", a direction from a lower side to an upper side in FIG. 3 will be referred to as "Z(+) direction", and a direction from the upper side to the lower side in FIG. 3 will be referred to as "Z(−) direction". Thus, in FIG. 1, an upper surface 3A and a lower surface 3B of the core part 3 are directed parallel to X-Y plane, and a pair of side surfaces 3C and 3D of the core part 3 are directed parallel to X-Z plane in FIG. 2.

Each flange 4 is integrally with each axial end (in X direction) of the core part 3. Each flange 4 is formed into a parallelepiped. Each flange 4 has a width (Y direction) identical to that of the core part 3. Further, each flange 4 protrudes from the upper and lower surfaces 3A and 3B of the core part 3 in Z direction. Further, an axis of the core part 3 is offset toward Z(−) direction from a vertically center portion of the flange 4. In other words, vertically protruding length in Z(+) direction of the flange 4 from the upper surface 3A is greater than vertically protruding length in Z(−) direction of the flange 4 from the lower surface 3B.

Each flange 4 has six surfaces. Among these, a top surface 4A and a bottom surface 4B are opposed to each other in Z direction, first and second side surfaces 4C and 4D are opposed to each other in the Y direction, and an outer end surface 4E and an inner end surface 4F are opposed to each other in X direction. The inner end surface 4F is positioned closer to the core part 3 than the outer end surface 4E to the core part 3. The top surface 4A and the bottom surface 4B are in parallel to the upper surface 3A of the core part 3. The top surface 4A functions as a terminal electrode forming surface, and the upper surface 3A of the core part 3 functions as a flat core surface.

The coil component 1 is a really super tiny chip having a length in x direction ranging from 1.0 to 1.6 mm, a length in Y direction ranging from 0.5 to 0.8 mm, and a length in Z direction ranging from 0.5 to 0.8 mm.

The flanges 4 are provided with a first terminal electrode 5 and a second terminal electrode 6, respectively. Each terminal electrode 5(6) is formed at an entire top surface 4A, and parts of the first and second side surfaces 4C, 4D and parts of the outer and inner end surfaces 4E, 4F, these parts being contiguous with the top surface 4A. To provide the terminal electrodes, Ag is coated over these portions, and then Ag is subjected to baking. Then, Ni plating layer is formed over the Ag layer, and Sn plating layer is formed over the Ni plating layer.

The conducting wire 7 is wound at a longitudinally center portion of the core part 3. The wire 4 includes a copper wire and insulation layer coated thereover. In case of the coil component of smaller size, the copper wire has a diameter ranging from 20 to 70 micron meters, and the insulation has a thickness ranging from 3 to 6 micron meters. In case of the coil component of larger size, the copper wire has a diameter ranging from 20 to 90 micron meters, and the insulation has a thickness ranging from 3 to 6 micron meters.

The conducting wire 7 includes a winding portion 7A, connecting portions 7B, 7C, leading portions 7D, 7E, and intermediary portions 7F, 7G. The winding portion 7A is a spirally winding portion wound over the core part 3. More specifically, the winding portion 7A includes wire portions completely extending from one lateral edge to another lateral edge of the upper and lower surfaces 3A and 3B in Y direction, and completely extending from one upper edge to one lower edge of the side surfaces 3C and 3D in Z direction. Within this definition of the winding portion 7A, a wire portion that extends from one lateral edge of the upper surface 3A to a point along the way to the other upper edge in Y direction does not belong to the winding portion 7A. In the winding portion 7A, neighboring wires are in close contact to each other without any spacing.

The connecting portions 7B, 7C are end portions of the conducting wire 7. To form the connecting portions 7B, 7C, the end portions are thermally pressed in Z(−) direction against the first and second terminal electrodes 5, 6, respectively, to cause plastic deformation to thus provide a first connecting portion 7B and second connecting portion 7C.

The leading portions 7D, 7E are portions extending from the connecting portions 7B, 7C. The leading portions 7D, 7E includes a first leading portion 7D connected to the first connecting portion 7B, and a second leading portion 7E connected to the second connecting portion 7C. The first and second leading portions 7A, 7B include transit regions 7D-1, 7E-1 (first transit region 7D-1, second transit region 7E-1) positioned immediately beside the connecting portions 7B, 7C, and bending regions 7D-2, 7E-2 (first bending region 7D-2, second bending region 7E-2) positioned closer to the winding portion 7A than the transit regions to the winding portion 7A.

The first transit region 7D-1 is subjected to plastic deformation upon pressure in Z(−) direction at an area between the first connecting portion 7B and an intermediate position between the first connecting portion 7B and the winding portion 7A in X direction. Similarly, the second transit region 7E-1 is subjected to plastic deformation upon pressure in Z direction at an area between the second connecting portion 7C and an intermediate position between the second connecting portion 7C and the winding portion 7A in X direction. The plastic deformation in Z(−) direction at the transit regions 7D-1 and 7E-1 in cooperation with the plastic deformation of the first and second connecting portions 7B and 7C in Z(−) direction can prevent the first and second connecting portions 7B, 7C from moving away from the first and second terminal electrodes 5, 6, i.e., moving in Z(+) direction. Further, these plastic deformations can prevent the first and second transit regions 7D-1, 7E-1 from arcuately deforming away from the inner end surfaces 4F of the flanges 4, 4. Consequently, when surface-mounting the coil component 1 onto a circuit board, the first and second terminal electrodes 5, 6 mounting thereon the first and second connecting portions 7B, 7C can be easily electrically connected to an electrically conductive pattern of the circuit board at high accuracy.

The intermediary portions 7F, 7G include a first intermediary portion 7F located between the winding portion 7A and the first bending region 7D-2. More specifically, as shown in FIG. 2, the first intermediary portion 7F is a wire portion from the upper edge of the upper surface 3A to a point in the way to the other upper edge of the upper surface 3A in Y direction. Similarly, intermediary portions 7F, 7G include a second intermediary portion 7G located between the winding portion 7A and the second bending region 7E-2. More specifically, the second intermediary portion 7G is a wire portion from the other upper edge of the upper surface 3A to a point in the way to the one upper edge of the upper surface 3A in Y direction.

The first intermediary portion 7F is oriented in a direction away from the winding portion 7A from the one upper edge of the upper surface 3A toward the first terminal electrode 5, and is oriented in Z(+) direction away from the upper surface 3A. The portion 7F is bent near the first bending region 7D-2, so that the first transit region 7D-1 can extend in X(−) direction to be connected to the first terminal electrode 5.

Figure 2:
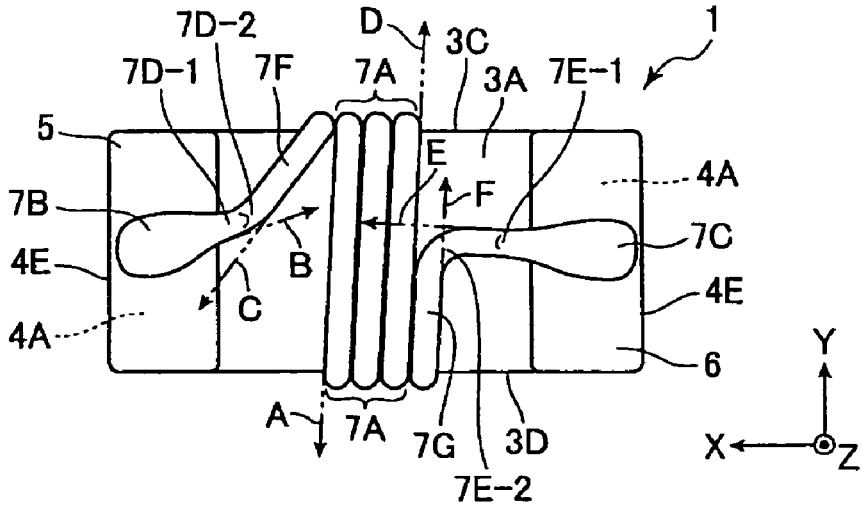
FIG. 2 is a plan view of the coil component according to the embodiment.

In FIG. 2, three arrows A, B, and C are shown. In the illustrated embodiment, an angle between the arrows A and B is about 120 degrees, and an angle between the arrows B and C is about 150 degrees, in which the arrow A is indicative of extending direction of conducting wire 7 in the winding portion 7A on the upper surface 3A, the arrow B is indicative of extending direction of the first transit region 7D-1 toward the winding portion 7A, and the arrow C is indicative of extending direction of the first intermediary portion 7F toward the first bending region 7D-2. The arrow A is slightly inclined with respect to a widthwise direction (of the core part 3) perpendicular to the longitudinal direction of the core part 3 for spiral winding.

The second intermediary portion 7G is oriented in a direction parallel to the extending direction of the wire 7 in the winding portion 7A and is in close contact therewith. The wire is gently curved at the second bending region 7E-2 and is oriented in Z(+) direction away from the upper surface 3A, so that the second transit region 7E-1 can extend in X(−) direction to be connected to the second terminal electrode 6.

In FIG. 2, three arrows D, E, and F are shown. In the illustrated embodiment, an angle between the arrows D and E is 90 degrees, and an angle between the arrows E and F is 90 degrees, in which the arrow D is indicative of extending direction of conducting wire 7 in the winding portion 7A on the upper surface 3A, the arrow E is indicative of extending direction of the second transit region 7E-1 toward the winding portion 7A, and the arrow F is indicative of extending direction of the second intermediary portion 7G toward the second bending region 7E-2. Similar to the arrow A, the arrow D is slightly inclined with respect to the widthwise direction (of the core part 3) perpendicular to the longitudinal direction of the core part 3 for spiral winding.

As shown in FIG. 1, the resin part 8 is adapted to cover portions of the core part 3, the winding portion 7A and the flanges 4, the portions being offset in Z(−) direction from a vertically center portion of the flanges 4. The resin part 8 can be provided by dipping the coil assembly into a liquidized resin. The resin part 8 has a flat bottom end surface. Therefore, a suction nozzle (not shown) can be in contact with the flat bottom surface for surface-mounting the coil component 1 onto the circuit board (not shown).

Upon pressure deformation of the second connecting portion 7C and the second transit region 7E-1 for the electrical connection to the second terminal electrode 6, the deformed part of the wire may be urged in the extending direction of the second transit region 7E-1. However, the urging force does not cause unwinding of the winding portion 7A but causes further winding of the winding portion 7A since the arrows D and E define the angle of 90 degrees as described above. In other words, the urging force subjected to the wire due to the pressure deformation can be concentrated or absorbed into the second transit region 7E-1 because of the angle.

Consequently, increase in diameter in the winding portion 7A due to unwinding can be obviated, thereby restraining variation in shape of the winding portion 7A to ensure dimensional stability of the coil component 1. Further, variation in inductance (L) characteristics can be avoided. For example, tolerance of plus minus 2% is available in case of the inductance (L) characteristics of 10 nH (nanohenry).

Further, the urging force subjected to the wire can be further concentrated toward the second transit region 7E-1 because of the angle of 90 degrees defined by the arrows E and F.

Further, electrical connection of the wire 7 to the second terminal electrode 6 can be facilitated, and degradation of winding after electrical connection can be restrained, since the electrode forming surface (top surface 4A) of the flange 4 and the upper surface 3A of the core part 3 are in parallel to each other and since the second transit region 7E-1 is directed in a direction the same as that of the orientation of the second connecting portion 7C.

Further, the second intermediary portion 7G can be subjected to positioning on the upper surface 3A by the winding portion 7A and application of urging force due to the above-described plastic deformation to the second intermediary portion 7G can be minimized, since the second intermediary portion 7G is in direct contact with the winding portion 7A.

Further, since a part of the second transit region 7E-1 is positioned spaced away from the core part 3 and the flange 4, the spaced away part of the region 7E-1 can effectively absorb the urging force.

Further a sufficient spanning length of the wire between the intermediary portion 7F(7G) and the terminal electrode 5(6) can be obtained, since protruding length of the flange 4 from the upper surface 3A is greater than that from the lower surface 3B and terminal electrodes 5 and 6 are formed on the larger protruding part of the flange 4. Therefore, the spanning part of the wire can absorb greater amount of urging force.

Further, winding state at the winding portion 7A can be maintained avoiding unwinding of the wire to cause increase in spiral diameter, since the resin part 8 holds the part of the winding portion 7A.

Further, orientation of the coil component can be easily recognized by observing the layout of the wire in FIG. 2 where the angle defined by the arrows A and B is different from the angle defined by the arrows D and E. In other words, point symmetry of the wire with respect to the winding portion 7A is not provided as shown in FIG. 2, so that a user or a machine can easily recognize the orientation of the coil component 1.

Further, application of urging force to the wire part spanning between the winding portion 7A and the connecting portion 7C can be reduced, since the bending region 7E-2 is provided at a connecting zone between the second intermediary portion 7G and the second transit region 7E-1.

Figure 4:
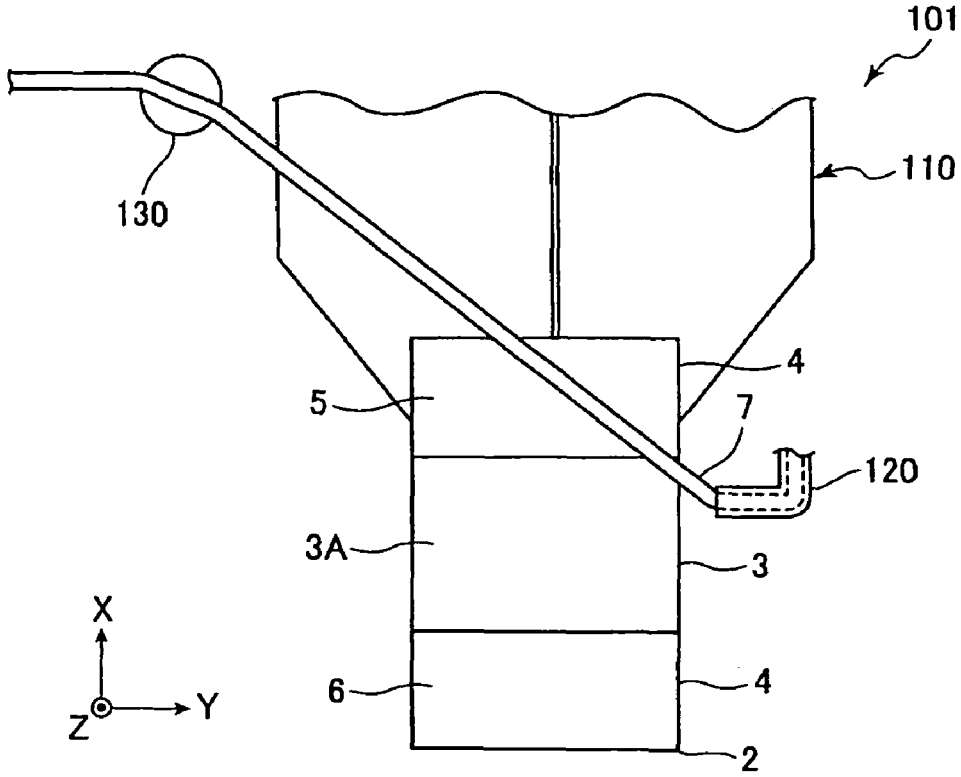
FIG. 4 is a partial plan view for description of a method for producing the coil component according to the embodiment, and showing a state where a potential first connecting portion is positioned immediately above a first terminal electrode.
Figure 5:
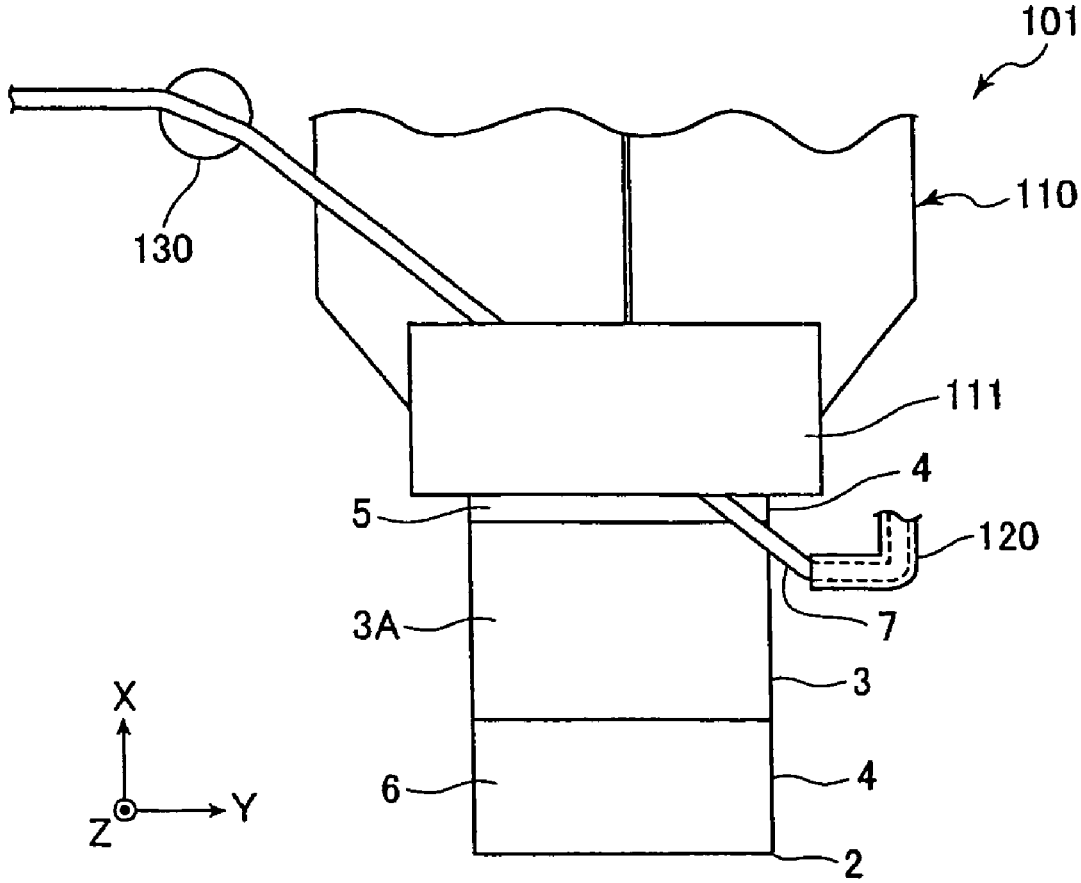
FIG. 5 is a partial plan view for description of the method and showing a state where the potential first connecting portion is thermally pressure-bonded to the first terminal electrode.

Next, a device 101 for producing the coil component 1 will be described with reference to FIGS. 4 through 10. The device 101 includes a spindle winding device (FIG. 4), a wire clamp 130, a heater 111 (FIG. 5), a cutter (not shown), a wire retainer (FIG. 8), and a single nozzle 120. The spindle winding device is adapted for winding a conducting wire 7 over the coil part 3 by rotating the drum type core 2 about an axis of the core part 3. As shown in FIG. 4, the winding device includes a chuck 110 that holds the drum type core 2. The nozzle 120 is adapted to supply the conducting wire for spirally winding the conducting wire 7 over the core part 3 held by the chuck 110.

The chuck 110 is adapted for nipping one of the flanges 4 of the drum type core 2 as shown in FIG. 4. The chuck 110 is drivingly connected to a rotation drive unit (not shown) so as to rotate the drum type core 2 about the axis of the core part 3. Upon rotation of the chuck 110 nipping the drum type core 2, the drum type core 2 is rotated about the axis for winding the conducting wire 7 supplied from the nozzle 2 over the core part 3.

The wire clamp 130 is adapted for fixedly nipping one end portion of the conducting wire 7 supplied from the nozzle 120. As described later, the wire 7 can be fed out of the nozzle in accordance with the movement of the nozzle 120, since the one end portion of the wire 7 is fixed by the clamp 130.

The nozzle 120 is adapted to pay out the wire 7, and is drivingly connected to a nozzle drive unit (not shown) so that the nozzle 120 can be moved in a three dimensional direction while a tip of the nozzle 120 is always directed perpendicular to the axis of the core part 3.

The heater 111 is a heater chip, and can be positioned vertically above the drum type core 2, and is movable in the three dimensional directions. The heater 111 is adapted to thermally press the end portion of the wire 7 (corresponding to connecting portions 7B, 7C) onto the terminal electrodes 5, 6 for removing the insulation coating of the wire 7 and electrically connecting the wire to the electrodes 5, 6 to provide the connecting portions 7B, 7C by the downward movement of the heater 111.

The cutter (not shown) is adapted to cut the wire 7, and is movable in three dimensional directions. Normally, the cutter is at its rest position to avoid mechanical interference with the nozzle 120 and wire 7 paid out from the nozzle 120.

The wire retainer includes a generally rectangular holder 112. The holder 112 has a tip end 112A formed into a roundish shape (round chamfering). The tip end 112 is adapted to hold the second intermediary portion 7G. The holder 112 has a bottom surface formed into flat shape in contact with the wire 7. The holder 112 is made from a material that does not damage to the wire 7 or having hardness higher than that of the copper to facilitate bending of the wire. For example, stainless steel, high hardness rubber providing lesser elastic deformation, and Teflon (trademark, polytetrafluoroethylene) are available as the material of the holder 112.

A method for producing the coil component will next be described. First, a drum type core 2 provided with the first and second terminal electrodes 5 and 6 is prepared. Then, the chuck 110 nips one of the flanges 4 as shown in FIG. 4.

Then, the wire 7 is paid out from the nozzle 120 so as to clamp one end portion of the wire 7 at the chuck 130. Thus, one end portion of the wire 7 can be positioned with respect to the chuck 110. Then, while paying out the wire from the nozzle 120, a part of the wire (corresponding to the first connecting portion 7B) is positioned over the first terminal electrode 5 as shown in FIG. 4.

Then, the heater 111 is vertically moved downward to thermally press the wire portion (corresponding to the first connecting portion 7B) onto the first terminal electrode 5. Thus, the insulation coating at the wire portion is removed, and the wire portion is electrically connected to the first terminal electrode 5 to provide the first connecting portion 7B.

Figure 3:
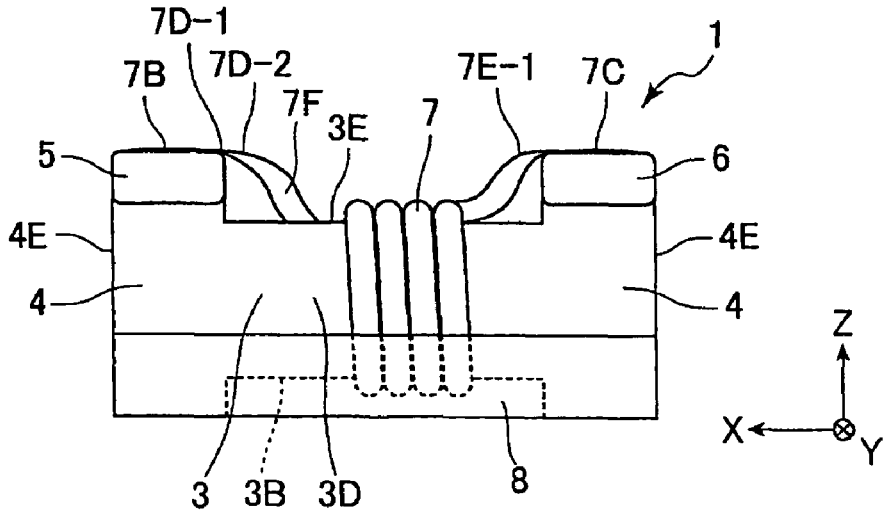
FIG. 3 is a side view of the coil component according to the embodiment.
Figure 6:
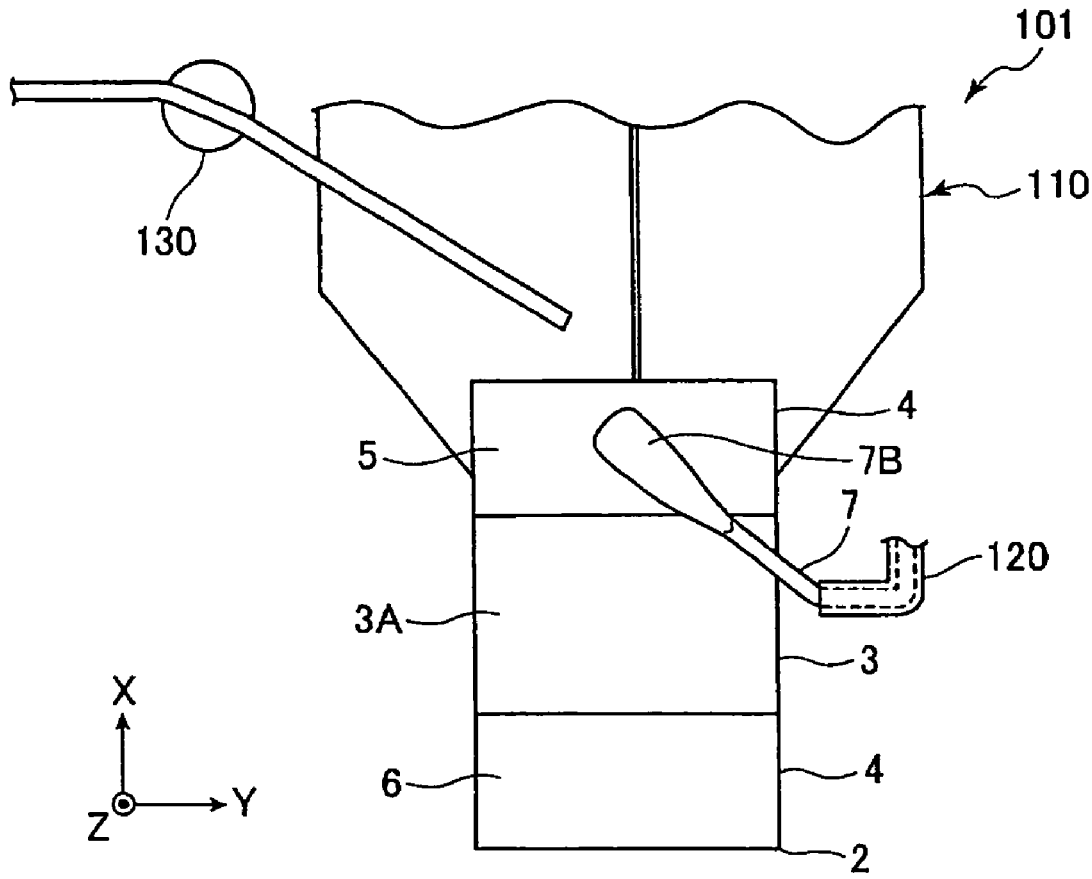
FIG. 6 is a partial plan view for description of the method and showing a state where a conducting wire of a wire clamp side with respect to the first connecting portion is cut out.

By the thermal pressing, the wire portion is deformed or squashed in Z(−) direction to provide the first connecting portion 7B, and a wire portion corresponding to the first transit region 7D-1 of the first leading portion 7D is also deformed or squashed in Z(−) direction as shown in FIGS. 2 and 3, the first transit region 7D-1 being between the first connecting portion 7B and an intermediate portion between the first connecting portion 7B and the winding portion 7A in the X direction. Then, a portion between the first connecting portion 7B and a wire portion extending to the wire clamp 130 from the first connecting portion 7B is subjected to cutting as shown in FIG. 6.

Figure 7:
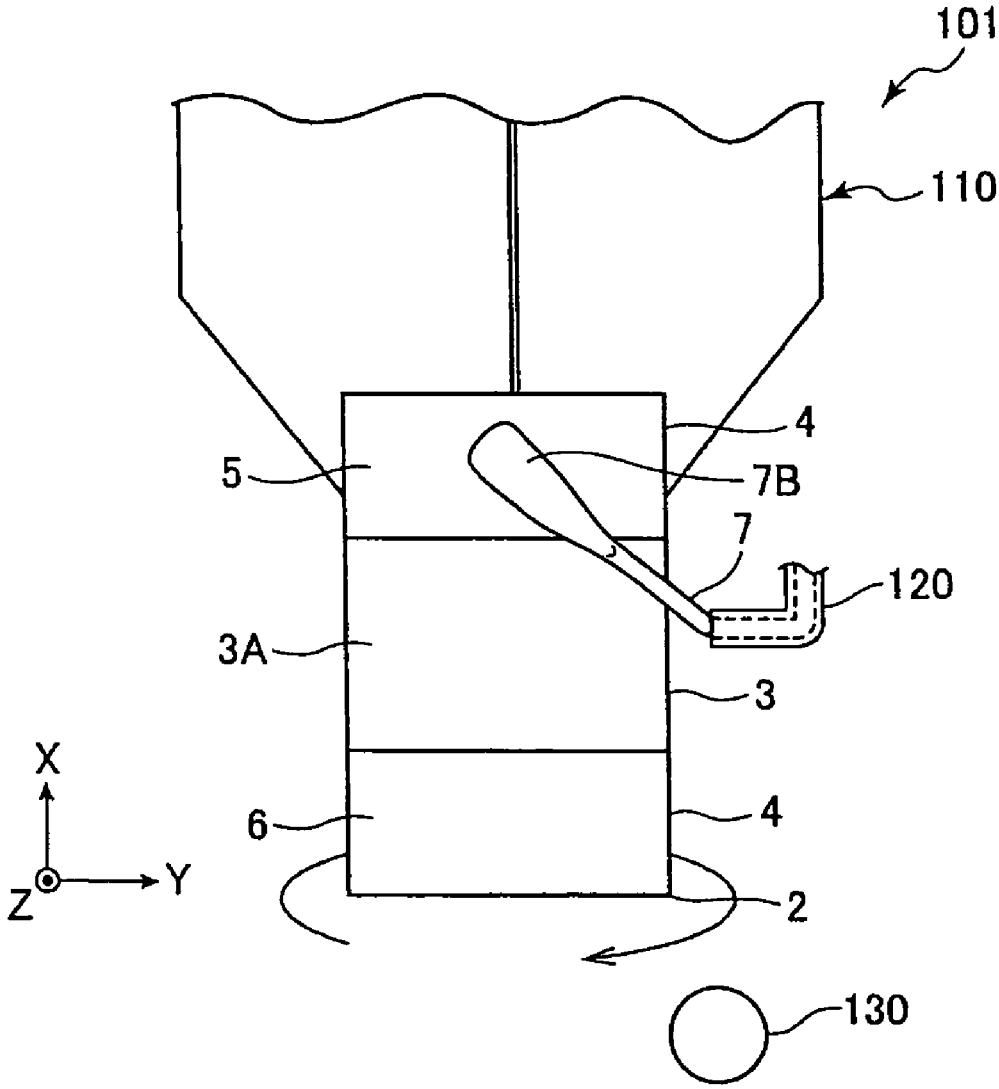
FIG. 7 is a partial plan view for description of the method and showing a state where the conducting wire is wound over a core part.

Then, as shown in FIG. 7, the chuck 110 is rotated, while the nozzle 120 is moved in the axial direction of the core part 3, so that the wire 7 is wound over the core part 3 to provide the winding portion 7A.

Figure 8:
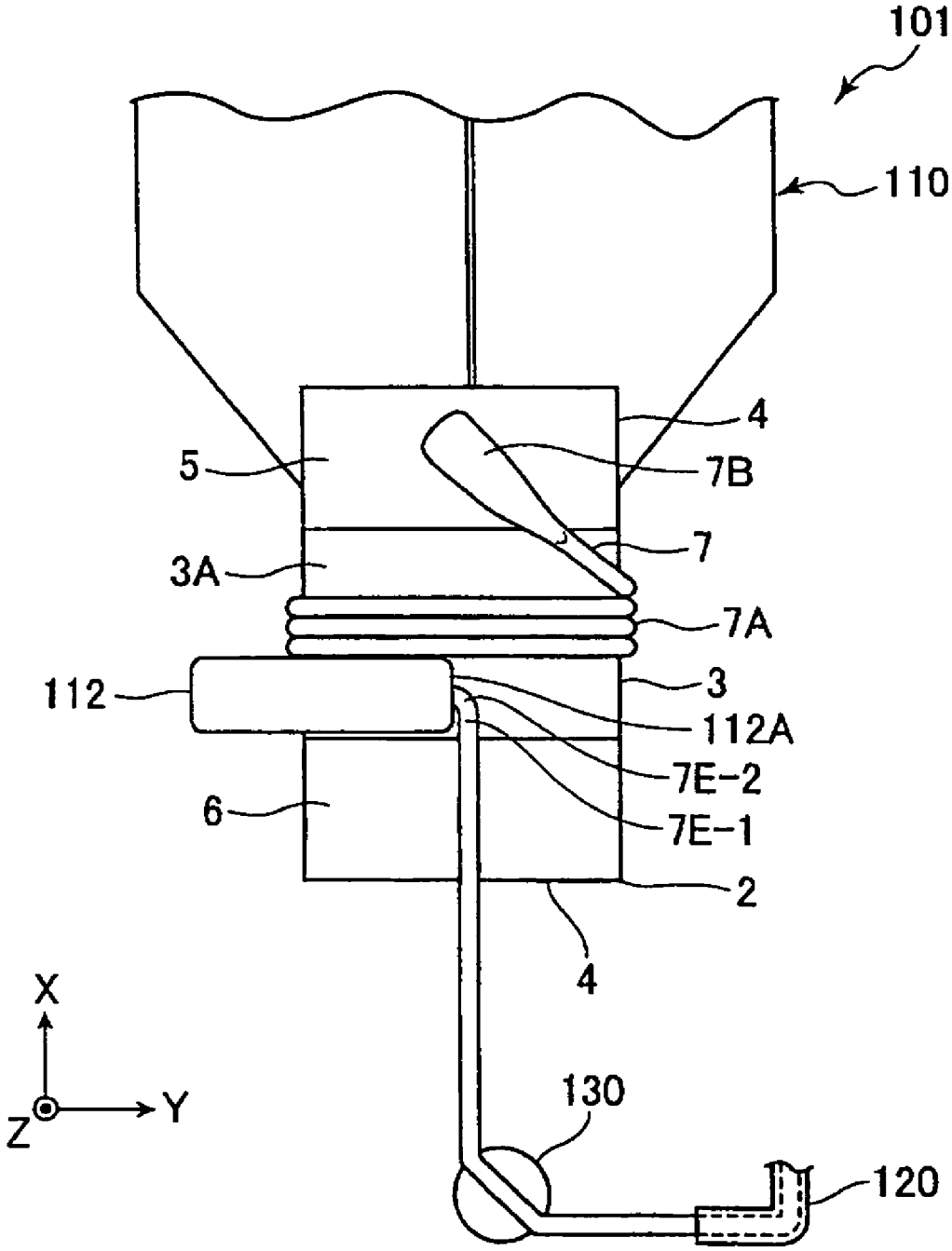
FIG. 8 is a partial plan view for description of the method and showing a state where a part of the conducting wire is positioned above a second terminal electrode.

Then, wire orientation or positioning process is carried out to direct the part of the wire in order to provide the second intermediary portion 7G and the second leading portion 7E. First, the wire 7 is paid out in Y(+) direction (almost coincident with the spiral winding direction of arrows D and F in FIG. 2) so that the wire 7 extends to a half widthwise length of the upper surface 3A of the core part 3. Then, the holder 112 holds the wire in such a manner that the tip end 112A of the holder 112 is aligned with the widthwise center of the upper surface 3A to provide the second intermediary portion 7G as shown in FIG. 8. The tip end 112A provides the holding force capable of avoiding damage to the wire 7 and deformation thereof.

Then, the wire clamp 130 clamps a part of the wire 7, the part being located closer to the nozzle 120 than the tip end 112A to the nozzle 120. Then, the wire clamp 130 is moved so as to orient the wire part in the direction of the arrow E in FIG. 2 thereby providing the angle of 90 degrees between the arrows E and F, whereupon the wire part is positioned over the second terminal electrode 6 as shown in FIG. 8.

Figure 9:
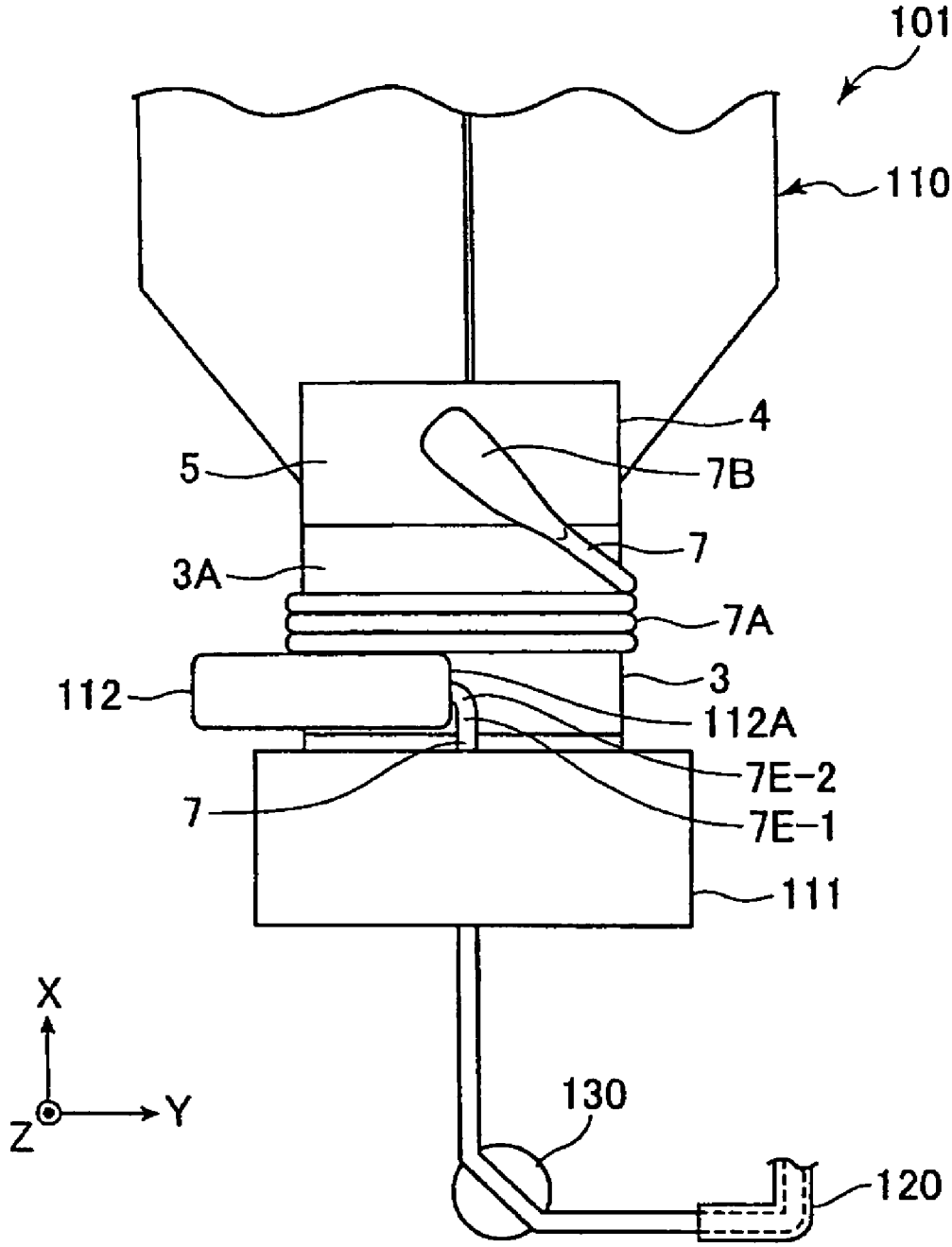
FIG. 9 is a partial plan view for description of a method and showing a state where a potential second connecting portion is connected by heat and pressure to the second terminal electrode.

Then, the wire part is electrically connected to the second terminal electrode 6. More specifically, as shown in FIG. 9, the heater 111 is vertically moved downward to thermally press the wire portion (corresponding to the second connecting portion 7C) onto the second terminal electrode 6. Thus, the insulation coating at the wire portion is removed, and the wire portion is electrically connected to the second terminal electrode 6 to provide the second connecting portion 7C. This process is performed with maintaining holding of the wire part by the holder 112 as shown in FIG. 9.

By the thermal pressing, the wire portion is deformed or squashed in Z(−) direction to provide the second connecting portion 7C, and a wire portion corresponding to the second transit region 7E-1 of the second leading portion 7E is also deformed or squashed in Z(−) direction as shown in FIGS. 2 and 3, the second transit region 7E-1 being between the second connecting portion 7C and an intermediate portion between the second connecting portion 7C and the winding portion 7A in the X direction.

Figure 10:
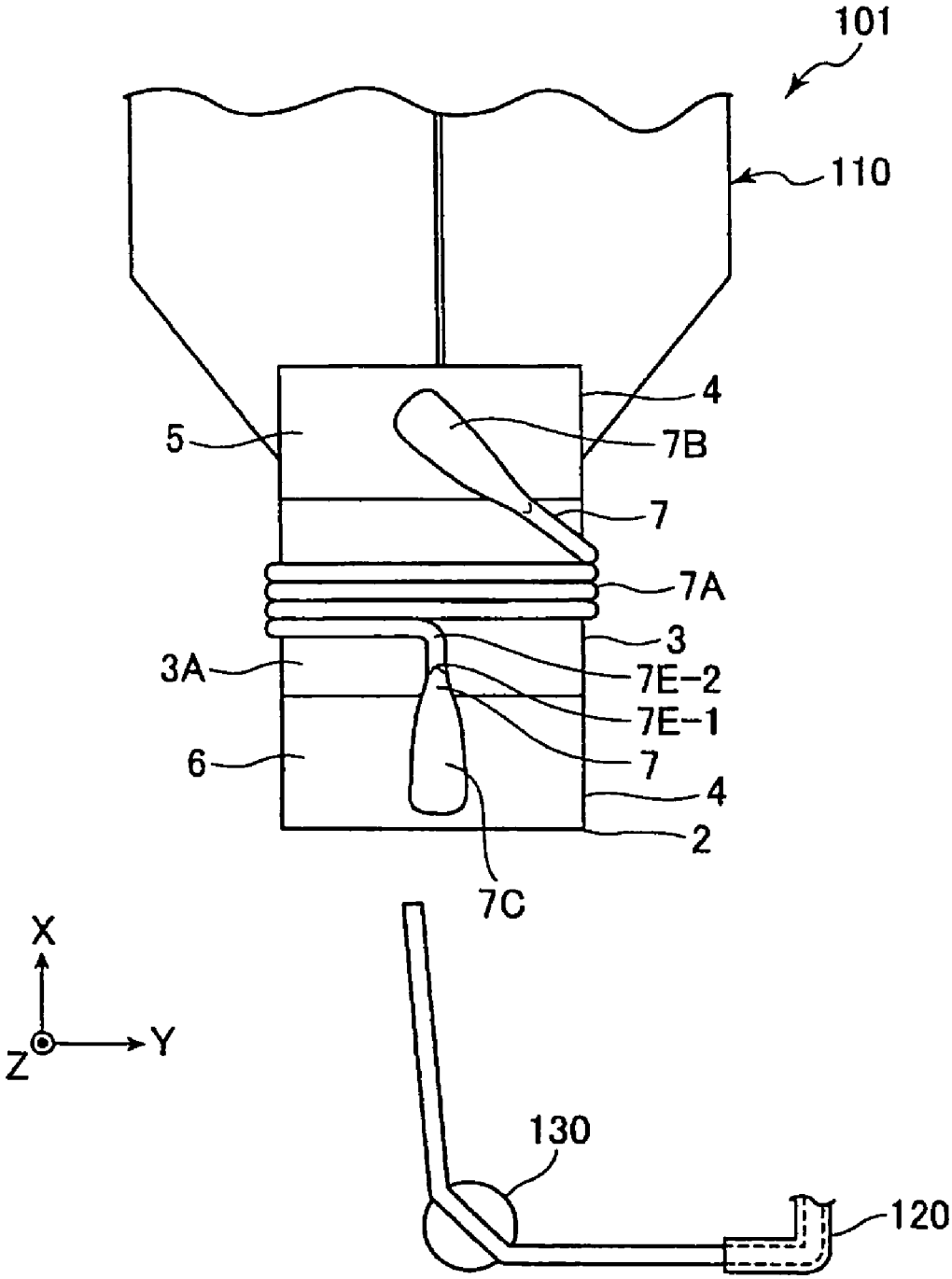
FIG. 10 is a partial plan view for description of the method and showing a state where a conducting wire of a wire clamp side with respect to the second connecting portion is cut out.

Then, a portion between the second connecting portion 7C and a wire portion extending to the wire clamp 130 from the second connecting portion 7C is subjected to cutting as shown in FIG. 10. Then, the resin part 8 is provided by dipping or resin coating or attachment of resin films to cover the deviated Z(−) part of the drum type core 2 and the deviated Z(−) part of the winding portion 7A, the deviated part being the lower part, and less than the half of the flange 4 in the vertical direction as described above. Thus, the coil component 1 can be provided.

In the thermal pressing process for forming the second connecting portion 7C, the wire part is deformed and urged by the heat and pressure in the extending direction of the second transit region 7E-1. However, since the holder 112 maintains holding to the intermediary portion 7G positioned downstream in the urging direction, the urging force can be concentrated and absorbed into the second transit region 7E-1.

Therefore, unwinding of the wire at the winding portion 7A can be avoided to obviate increase in diameter at the winding portion 7A. Accordingly, variation in shape of the winding portion 7A can be restrained, to reduce dimensional variation of the coil component. Further, variation in inductance (L) characteristics of the coil component can also be prevented.

Further, in the wire orientation process, the wire clamp 130 is moved so as to position the part of the wire in alignment with the second terminal electrode 6 in such a manner that the wire is bent so as to provide the angle of 90 degrees between the arrows D and E and between the arrows E and F. Accordingly, when urging force is exerted on the second transit region 7E-1 as a result of formation of the second connecting portion 7C by thermal pressing, the urging force is not directed to unwind the winding portion 7A but is directed to further wind the winding portion 7A. Consequently, the urging force can be concentrated and absorbed into the second transit region 7E-1. This concentration and absorption can further be ensured by holding the second intermediary portion 7G by the holder 112.

Further, the second intermediary portion 7G is held by the tip end 112A of the holder 112, and the tip end 112A is chamfered into roundish shape as described above. Therefore, any damage to the wire part upon bending at the tip end 112A can be avoided.

Further, the upper surface 3A of the core part 3 and the bottom surface of the holder 112 are formed into flat shape. Therefore, the wire part corresponding to the second intermediary portion 7G can be nipped between flat surfaces, thereby stabilizing holding of the wire part.

Various modifications are conceivable. For example, in the above-described embodiment, the angles between the arrows D and E and between the arrows E and F are both 90 degrees as shown in FIG. 2. However, acute angle is also available instead of 90 degrees.

Further, in the above-described embodiment, the angle between the arrows A and B is about 120 degrees and the angle between the arrows B and C is about 150 degrees. However, the angles can be both 90 degrees. In the latter case, point symmetry is provided when viewing from the top of the coil component, thereby providing non-directionality of the coil component.

Further, in the above-described embodiment, the second intermediary portion 7G is directed parallel to the winding portion 7A on the upper surface 3A, and is in close contact therewith. However, the second intermediary portion 7G can be directed away from the upper surface 3A from the one lateral edge of the upper surface 3A, and the second transit region 7E-1 can be positioned away from the flange 4 and the core part 3.

Further, in the above-described embodiment, the heater chip 111 is employed for thermal pressing. However, a combination of a horn and anvil is also available instead of the heater chip. In the latter case, ultrasonic oscillation is imparted to perform ultrasonic welding while the horn and anvil interpose therebetween the flange 4 and the wire part corresponding to the connecting portion 7B (7C) positioned on the terminal electrodes 5 (6) on the flange 4. Solid-phase diffusion bonding can occur between the copper wire of the conducting wire 7 and the terminal electrode to cause electrical connection therebetween. More specifically, the drum type core 2 is fixed to the anvil, and the wire 7 is oscillated in synchronism with the horn. During initial stage of oscillation, any oxide film and grime at the boundary surface is removed, and electrical connection between the wire 7 and the terminal electrode can be completed upon elapse of predetermined oscillation time period (upon reaching predetermined energy.)

Further, in the above-described embodiment, the drum type core 2 is employed. However, other type of core is also available. Further, the core part 3 has the rectangular cross-section. However, other cross-sectional shape is also available. Furthermore, in the above-described embodiment, the wire is wound over the core part 3 without any spacing between neighboring wires in the winding portion 7A. However, the neighboring wires can be spaced away from each other.

Further, in the above-described embodiment, the spindle winding device is employed in which the drum type core 2 is rotated about its axis for winding the wire over the core part 3. However, flyer type winding device is also available in which a flyer is circularly moved around the core part. Furthermore, in the above-described embodiment, the tip end 112A of the holder 112 is formed into chamfered roundish shape. However, a flat corner chamfering is also available.

Thus, the present invention would be particularly available for a downsized or small-scale coil component requiring lesser variation in dimension, shape and inductance (L) characteristic.

While the invention has been described in detail with reference to the specific embodiment thereof, it would be apparent to those skilled in the art that various changes and modifications may be made therein without departing from the scope and spirit of the invention.

The invention claimed is:

1. A coil component comprising:

a core having a core surface and each end portion;

terminal electrodes each provided at each end portion of the core; and, a conducting wire comprising a winding portion wound over the core, and end portions including connecting portions each electrically connected to each terminal electrode and leading portions each provided between the winding portion and each connecting portion, each leading portion including a transit region connected to each connecting portion, the wire in the winding portion extending in a first direction on the core surface at a side identical to a side where the connecting portion is provided, and the transit region extending in a second direction toward the winding portion on the core surface, and the first direction and the second direction defining an angle therebetween of not more than 90 degrees.

2. The coil component as claimed in claim 1, wherein the core surface includes terminal electrode forming surfaces on which the terminal electrodes are formed, and a core part surface on which the winding portion is provided, the terminal electrode forming surfaces and the core part surface being flat and parallel to each other; and wherein the conducting wire further comprises intermediary portions each provided between each leading portion and the winding portion, at least one of the intermediary portions extending in the extending direction of the winding portion on and along the core part surface.

3. The coil component as claimed in claim 2, wherein at least one of the intermediary portions extending in a third direction on the core part surface, and the third direction and the second direction defining an angle therebetween of not more than 90 degrees.

4. The coil component as claimed in claim 3, wherein the at least one of the intermediary portions is in contact with the winding portion in the extending direction thereof.

5. The coil component as claimed in claim 1, wherein the connecting portions are deformed toward the associated terminal electrodes; and wherein the transit regions have an area starting from the connecting portion and ending at an intermediate point between the connecting portion and the winding portion, the area being also deformed toward the core portion.

6. The coil component as claimed in claim 1, wherein the core comprises a core part providing the winding portion and having each end, and a pair of flanges each provided at each end of the core part, each terminal electrode being provided at each flange, the transit region being away from the flange and the core part.

7. The coil component as claimed in claim 6, wherein the core part provides an axis, and the flange has one side formed with the terminal electrode and opposite side; and wherein the axis is deviated toward the opposite side in a direction connecting the one side to the opposite side.

8. The coil component as claimed in claim 7, further comprising a resin part covering a part of the winding portion.

9. The coil component as claimed in claim 8, wherein the resin part is provided at a deviated side of the core part and the flanges.

10. The coil component as claimed in claim 1, wherein the terminal electrodes comprise a first terminal electrode and a second terminal electrode; and wherein the connecting portions comprise a first connecting portion electrically connected to the first terminal electrode, and a second connecting portion electrically connected to the second terminal electrode; and wherein the leading portions comprise a first leading portion including a first transit region connected to the first connecting portion, and a second leading portion including a second transit region connected to the second connecting portion; and wherein the winding portion extends in the first direction and the first transit region extends in a fourth direction, and the first direction and the fourth direction define an obtuse angle therebetween; and wherein the second transit region extends in the second direction, and the first direction and the second direction define the angle therebetween of not more than 90 degrees.

11. The coil component as claimed in claim 1, wherein each leading portion further includes a bending region bendingly connected to each intermediary portion.

12. A method for producing a coil component comprising:

preparing a core provided with first terminal electrode and second terminal electrode;

first electrically connecting one end portion of a conducting wire to the first terminal electrode to provide a first connecting portion;

winding the conducting wire at a downstream of the one end portion over the core to provide a winding portion wherein the first connecting portion is defined herein as an upstream end;

positioning a portion of the conducting wire at a downstream of the winding portion onto the second terminal electrode by holding a potential intermediary portion by a holder and bending the conducting wire at the holder toward the second terminal electrode to provide a potential leading portion, wherein the potential intermediary portion is positioned immediate downstream of the winding portion and becomes an intermediary portion, and the potential leading portion is positioned immediate downstream of the potential intermediary portion and becomes a leading portion including a transit region; and second electrically connecting the portion of the conducting wire immediate downstream of the leading portion to the second terminal electrode by applying pressure to the portion to provide a second connecting portion, the transit region being immediate upstream of the second connecting portion.

13. The method as claimed in claim 12, wherein in the positioning step, the potential intermediary portion is directed in a direction parallel to an extending direction of the conducting wire in the winding portion when viewing to one surface of the core, the surface being parallel to a surface of the core at which the first connecting portion and second connecting portion are provided.

14. The method as claimed in claim 12, wherein in the positioning step, the conducting wire is bent in such a manner that an extending direction of the wire in the winding portion and an extending direction of the transit region define an angle therebetween of not more than 90 degrees when viewing to one surface of the core, the surface being parallel to a surface of the core at which the first connecting portion and second connecting portion are provided.

15. The method as claimed in claim 12, wherein in the positioning step, the holder having one of a roundish chamfered end and flat chamfered end is used.

16. The method as claimed in claim 12, wherein in the second electrically connecting step, the second connecting portion is plastically deformed upon pressure toward the second terminal electrode, and the transit region is also plastically deformed in a region spanning from the second connecting portion to an intermediate point between the winding portion and the second connecting portion upon pressure toward the core.

* * * * *